US010180039B2

(12) United States Patent
Saltel et al.

(10) Patent No.: US 10,180,039 B2
(45) Date of Patent: Jan. 15, 2019

(54) DEVICE FOR CEMENTING A PIPE INTO A BOREHOLE WELL AND CORRESPONDING CEMENTATION METHOD

(71) Applicant: Saltel Industries, Bruz (FR)

(72) Inventors: Jean-Louis Saltel, Le Rheu (FR); Samuel Roselier, Le Rheu (FR); Romain Neveu, Saint Senoux (FR); Anas Gaby, Rennes (FR)

(73) Assignee: SALTEL INDUSTRIES, Bruz (FR)

( * ) Notice: Subject to any disclaimer, the term of this patent is extended or adjusted under 35 U.S.C. 154(b) by 0 days.

(21) Appl. No.: 15/743,476

(22) PCT Filed: Jul. 7, 2016

(86) PCT No.: PCT/EP2016/066059
§ 371 (c)(1),
(2) Date: Jan. 10, 2018

(87) PCT Pub. No.: WO2017/009155
PCT Pub. Date: Jan. 19, 2017

(65) Prior Publication Data

US 2018/0202258 A1 Jul. 19, 2018

(30) Foreign Application Priority Data

Jul. 10, 2015 (FR) ..... 15 56609

(51) Int. Cl.
*E21B 33/14* (2006.01)
*E21B 33/127* (2006.01)

(52) U.S. Cl.
CPC ..... *E21B 33/146* (2013.01); *E21B 33/1277* (2013.01); *E21B 33/14* (2013.01)

(58) Field of Classification Search
CPC ..... E21B 33/146; E21B 33/14; E21B 33/1277
(Continued)

(56) References Cited

U.S. PATENT DOCUMENTS 3,456,725 A 7/1969 Hatch
4,744,421 A 5/1988 Wood et al.
(Continued)

FOREIGN PATENT DOCUMENTS

FR 2988126 A1 9/2013
WO 2015028257 A1 3/2015

OTHER PUBLICATIONS

International Search Report dated Sep. 16, 2016, for corresponding International Application No. PCT/EP2016/066059, filed Jul. 7, 2016.

(Continued)

*Primary Examiner* — William D Hutton, Jr.
*Assistant Examiner* — Ashish K Varma
(74) *Attorney, Agent, or Firm* — David D. Brush; Westman, Champlin & Koehler, P.A.

(57) ABSTRACT

A device is provided for cementing a casing in a well bore. The device includes, on the well head side, a shutter disposed within the casing that controls opening and closing of at least one cementing aperture. The at least one cementing aperture makes an interior of the casing communicate with an annular space situated between an external face of the casing and an internal wall of the well. The device also includes, on the well bottom side, a packer having two expandable liners mounted along the external face of the casing and at least one communication passage between an exterior of the first external liner and the annular volume. The at least one communication passage is situated on the packer side orientated towards the well bottom.

14 Claims, 6 Drawing Sheets

(58) Field of Classification Search
USPC ..... 166/289
See application file for complete search history.

(56) References Cited

U.S. PATENT DOCUMENTS 5,526,878 A * 6/1996 Duell ..... E21B 33/127
166/187
9,506,314 B2 11/2016 Roselier et al.

OTHER PUBLICATIONS

English translation of the International Written Opinion dated Sep. 16, 2016, for corresponding International Application No. PCT/EP2016/066059, filed Jul. 7, 2016.

* cited by examiner

DEVICE FOR CEMENTING A PIPE INTO A BOREHOLE WELL AND CORRESPONDING CEMENTATION METHOD

CROSS-REFERENCE TO RELATED APPLICATIONS

This Application is a Section 371 National Stage Application of International Application No. PCT/EP2016/066059, filed Jul. 7, 2016, which is incorporated by reference in its entirety and published as WO 2017/009155 A1 on Jan. 19, 2017, not in English.

1. FIELD OF THE INVENTION

The invention relates to the field of drilling.

The invention more particularly relates to the cementing of a casing within a well bore.

The invention can be applied especially to petroleum, gas or geothermal wells.

2. PRIOR ART SOLUTIONS

After the drilling of a well bore, such as a petroleum well, a casing or liner is run down into the unfinished well bore and the annulus between the external wall of the casing. The internal wall of the well is then cemented throughout its height or on a part of its height.

The cementing of the annulus is aimed especially at:

- the resistance of the casing and its anchoring in the ground.
- preventing the migration of gas and liquids between the underground formations crossed (i.e. isolating these formations), and
- preventing gas from rising through the annulus that surrounds the casing.

The evolution of cementing quality over time depends on the initial quality of the cementing and especially on the phase of solidification of the cement once this cement has been injected into the annulus.

Once solidified, the cement placed in the annulus is subjected to numerous stresses (temperature, expansion of the casing, pressure in the well etc) throughout the service life of the well.

Over time, defects in the cementing can also arise. Examples of these are the appearance of cracks, the formation of a micro-annulus at the casing/cement interfaces (due to a loss of adhesion of the annulus with the cement) and/or cement/formation interfaces. The deterioration of the cementing over time can lead to leakages of gas towards the surface because the cement is no longer capable of coping with high pressures. This is not desirable.

3. SUMMARY OF THE INVENTION

The present invention is aimed at providing a solution to the shortcomings of prior-art cementing techniques.

Thus, the invention relates to a device for cementing a casing in a well bore.

According to the invention, the cementing device comprises:

on the well head side, shutter means, disposed within the casing, that control the opening and closing of at least one cementing aperture, said at least one cementing aperture making the interior of the casing communicate with the annular space situated between the external face of the casing and the internal wall of the well, on the well bottom side, a packer mounted along the external face of the casing, comprising:

- an expandable liner, called a "first external liner", the opposite extremities of which are fixedly attached to said external face of the casing, this casing, the first external liner and its extremities together demarcating an annular volume (E), the shutter means furthermore commanding the opening and the closing of at least one expansion aperture which makes the interior of the casing and said annular volume (E) communicate, this first external liner being liable to expand and get applied in a tightly sealed manner, on an intermediate part of its length, to the wall of the well,
- a second expandable liner, called "second internal liner" which extends between said casing and said first external liner, its extremities being also fixedly attached to the external face of said casing,
- at least one communication passage between the exterior of the first external liner and said annular volume, said communication passage being situated on the packer side orientated towards the well bottom.

The cementing device of the invention implements shutter means within the casing which command both the opening and the closing of one or more cementing ports for the annulus and one or more expansion ports of a packer, this packer being situated on the casing downstream (i.e. towards the bottom of the well) from the shutter means and having a structure with two expandable liners.

The shutter means are shifted sequentially so that, in a first phase, they enable the radial expansion of the two expandable liners and the tight-sealed application of the external liner against the wall of the well, and then in a second phase, the cementing of the annulus situated between the external face of the casing and the internal wall of the well.

The implementing of a structure with two expandable liners is advantageous in that it enables optimal tight sealing between the external surface of the casing and the internal surface of the drill-hole so that in particular, the cementing operation in the annulus part situated upstream to the liners is done efficiently.

This structure is furthermore efficient and robust. Even in the event of a collapse of the internal liner, the external liner remains applied in a tightly sealed manner against the internal surface of the drill-hole, ensuring the perennial nature of the isolation and preventing fluids/gases from rising in the cemented annulus towards the surface.

Nor does this structure need to be maintained in an expanded form under pressure, thus eliminating any problem of leakage of pressure.

In short, the application of a structure with two expandable liners in the device of the invention meets several goals:

- It thus serves as a base/support for the cement cast in the annulus around the casing (the cementing is therefore supported by the expanded liners),
- it prevents fluids/gases from rising when the cement is hardening, and
- it provides for long-term tight sealing in the event of defects (cracks, formation of micro-annulus etc) in the hardened cement situated in the annulus.

It protects the cement situated in the annulus during the solidification phase but also in the long term, under harsh conditions.

The cementing device of the invention is particularly well suited but not exclusively suited to the staged cementing (i.e. cementing in several steps) of a well.

According to one particular aspect of the invention, said at least one communication passage consists of a hole placed on the wall of said first external liner and leading into the part of said annular volume that extends between the two liners.

According to one particular aspect of the invention, the shutter means are axially mobile within the casing and can take a first position in which they close, at the same time, said at least one cementing aperture and said at least one expanding aperture, a second position in which they close said at least one cementing aperture and open said at least one expanding aperture and a third position in which they open, at the same time, said at least one cementing aperture and said at least one expansion aperture.

According to one particular aspect of the invention, there is a communication of fluid between the part of said annular volume that extends between the casing and the second internal liner and the annular space situated above the packer, between the external face of the casing and the internal wall of the well, when the mobile shutter means are in said first position in which they close, at the same time, said at least one cementing aperture and said at least one expansion aperture.

According to one particular aspect of the invention, the shutter means comprise at least one rupture disc closing at least one expansion aperture.

According to one particular aspect of the invention, the shutter means are affixed temporarily on the internal wall of the casing in the first position by at least one breakable retaining element.

According to one particular aspect of the invention, the shutter means comprise two shutter sleeves that are axially mobile within the casing.

According to one particular aspect of the invention, one of said two shutter sleeves is temporarily fixed to the internal wall of the casing in the second position by at least one breakable retaining element.

According to one particular aspect of the invention, the shutter means are intended to be shifted by at least one of the following means:

injection of pressure into the casing;

an actuating means that is conveyed by the flow of fluid in the casing;

descent into the casing of a control tool.

According to one particular aspect of the invention, the cementing device comprises first means for measuring the position of the mobile shutter means within the casing.

According to one particular aspect of the invention, the cementing device comprises second means for measuring the pressure prevailing in the annular spaces situated respectively upstream and downstream to the packer.

According to one particular aspect of the invention, the measuring means are configured so that they can communicate with a measuring tool taken down with a cable inside the casing.

The invention is also adapted to the primary cementing of a well.

The invention also concerns a method for cementing a casing (or a casing column) in a well bore.

According to the invention, such a method comprises:

a step for placing, in said well, a casing equipped with the cementing device as described here above;

a step for opening said at least one expansion aperture, said at least one cementing aperture being closed;

a step for injecting a fluid into the casing towards said at least one expansion aperture so as to enable the expansion of the first and second liners of the packer and, in a tightly sealed manner, apply the first external liner against the wall of the well;

following the injection step, a step for opening said at least one cementing aperture;

a step for injecting cement into the casing towards the annular space via said at least one cementing aperture;

a step for closing said at least one cementing aperture and said at least one expanding aperture;

4. LIST OF FIGURES

Other features and advantages of the technique described shall appear more clearly from the following description of several embodiments, given by way of simple illustratory and non-exhaustive examples and from the appended drawings of which:

5. DESCRIPTION

The appended figures, purely for the sake of simplification, show only one fraction of the vertical part of well bore A. It is naturally possible for this vertical portion to extend over a great length. For all the figures, it will be considered that the well head (which opens out into the open air) is situated towards the top of the figures, and the well bottom is situated towards the bottom.

Figure 1:
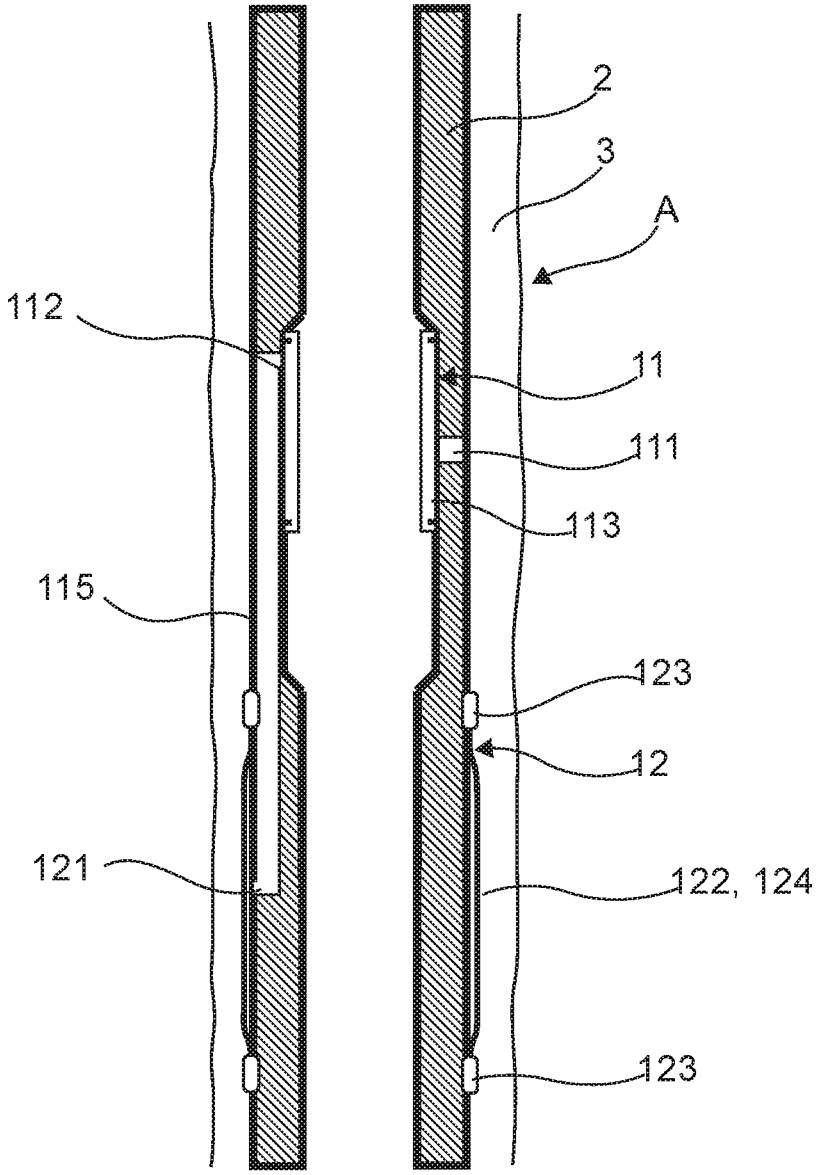
FIG. 1 is a partial schematic view along a longitudinal section, of a well bore in which the cementing device according to the invention is implemented.

FIG. 1 is a schematic view along the longitudinal section of a well bore A in which a casing column 2 partially represented incorporating the cementing device 1 according to a first embodiment of the invention.

The cementing device 1 comprises a differential valve 11 (DV) position towards the wellhead A and a packer 12 which is positioned beneath the differential valve 11 (towards the bottom of the well A).

The packer 12 implements a structure with two expandable liners 122, 124.

The packer 12 thus has a tubular metal liner called a "first external liner" 122, the opposite extremities of which are fixedly attached to the external face of the casing 2. More specifically, these extremities are gripped within annular reinforcement rings referenced 123 in FIG. 1. The packer 12 furthermore comprises a second tubular metal liner called "second internal liner" 124 which extends between the casing 2 and the first external liner 122, its extremities being sandwiched between those of the first external liner 122 and the external face of the casing 2 within the annular reinforcement rings 123.

The casing 2, the first external liner 122 and its ends together demarcate an annular volume E which is divided into two parts, in this case volume a E1 demarcated by a casing 2 and a second internal liner 124 and a volume E2 demarcated by the two liners 122, 124.

The wall of the casing 2 has a conduit 115 leading at one extremity into the casing through at least one aperture 112 and leading at the other extremity into the annular volume E so as to make the interior of the casing 2 communicate with the annular volume E.

The packer 12 also has at least one communication passage or hole 125 between the exterior of the first external liner 122 and the part E2 of said volume E which extends between the two liners. This hole 125 passes through the thickness of the wall of the first external liner 122 from one side to the other and is oriented downwards. The function of this hole 125 shall be explained further below.

The liners 122, 124 are liable to expand, the first external liner 122 being designed, on an intermediate part of its length, to get applied in a tightly sealed manner against the wall of the well A, and the second internal liner 124 is intended to be applied against the internal face of the first external liner 122.

In the case represented here, the two liners 122, 124 are made of a ductile metallic material.

However, the second internal liner 124 could be made of another expandable material such as a rubber-based elastically deformable material. The first external liner can be lined on a part of its length with a sealing layer, for example an elastically deformable material (of the elastomer type).

FIG. 1 shows the packer 12 before expansion of the liners 122, 124, these liners being therefore not deformed.

The differential valve 11, in the example illustrated, has a single tubular shutter sleeve 113 that is axially mobile along the internal wall of the casing 2.

This shutter sleeve 113 is intended to selectively open and close the aperture 112 for the expansion of the liners 122, 124 and at least one cementing aperture or port 111 making the interior of the casing 2 communicate with the annular space 3 situated between the external face of the casing 2 and the internal wall of the well. It can be noted that in the embodiments presented here, the expansion aperture 112 for the liners 122, 124 (which is on the well head side) is situated above the cementing aperture 111 (which is on the well bottom side), these two apertures being situated above the packer 12.

In the embodiments of FIGS. 1, 2A to 2E and 3A to 3E, the shutter sleeves 113 of the differential valve 11 are moved with a tool that is taken down into the interior of the casing 2 and gets hooked up with the shutter sleeves 113 in order to move them.

Figure 7:
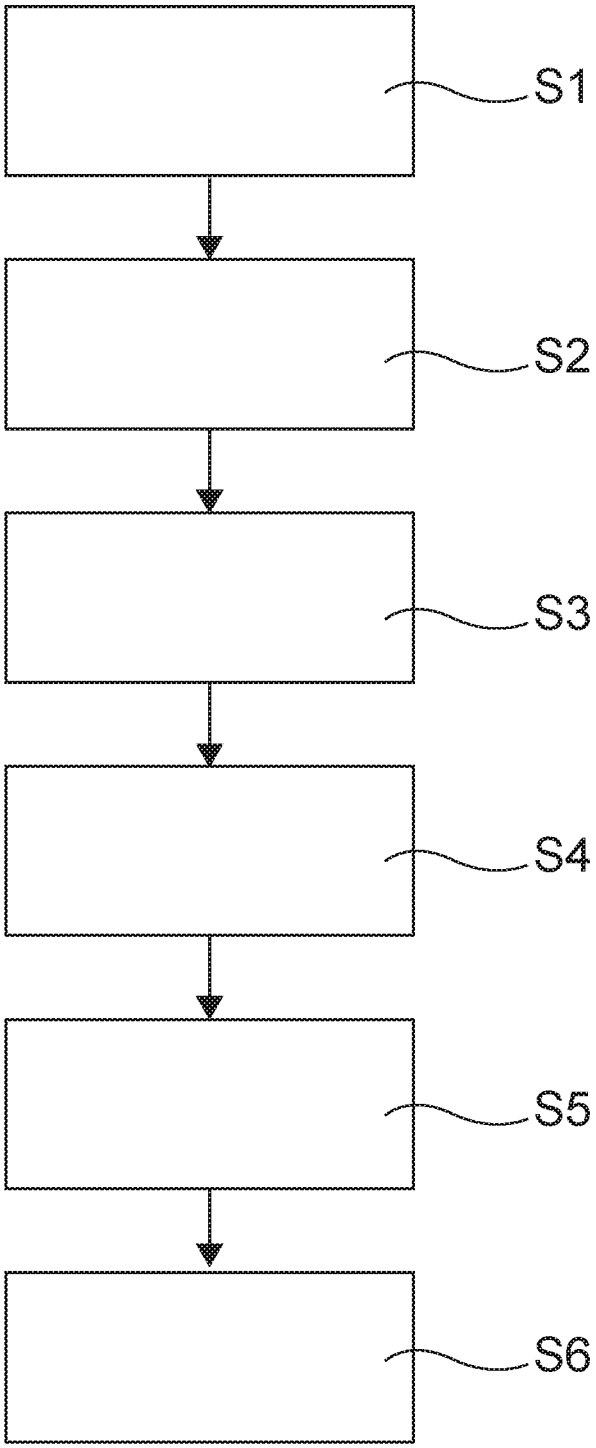
FIG. 7 is a schematic illustration of the steps of an example of implementation of the method according to the invention.

FIGS. 2A to 2E illustrate the cementing device of FIG. 1 and show the successive steps listed in FIG. 7 for implementing the cementing method according to the invention.

Here below, the description relates to the case where the cementing of the well A is a staged cementing operation, the casing 2 having been positioned in the well A (step S1) and the primary or initial cementing of the well A having been done in a known manner downstream from the cementing device 1. Once this primary cementing has been done, the casing 2 has been plugged by a plug positioned downstream from the cementing device 1.

Figures 2A, 2B, 2C, 2D, 2E:
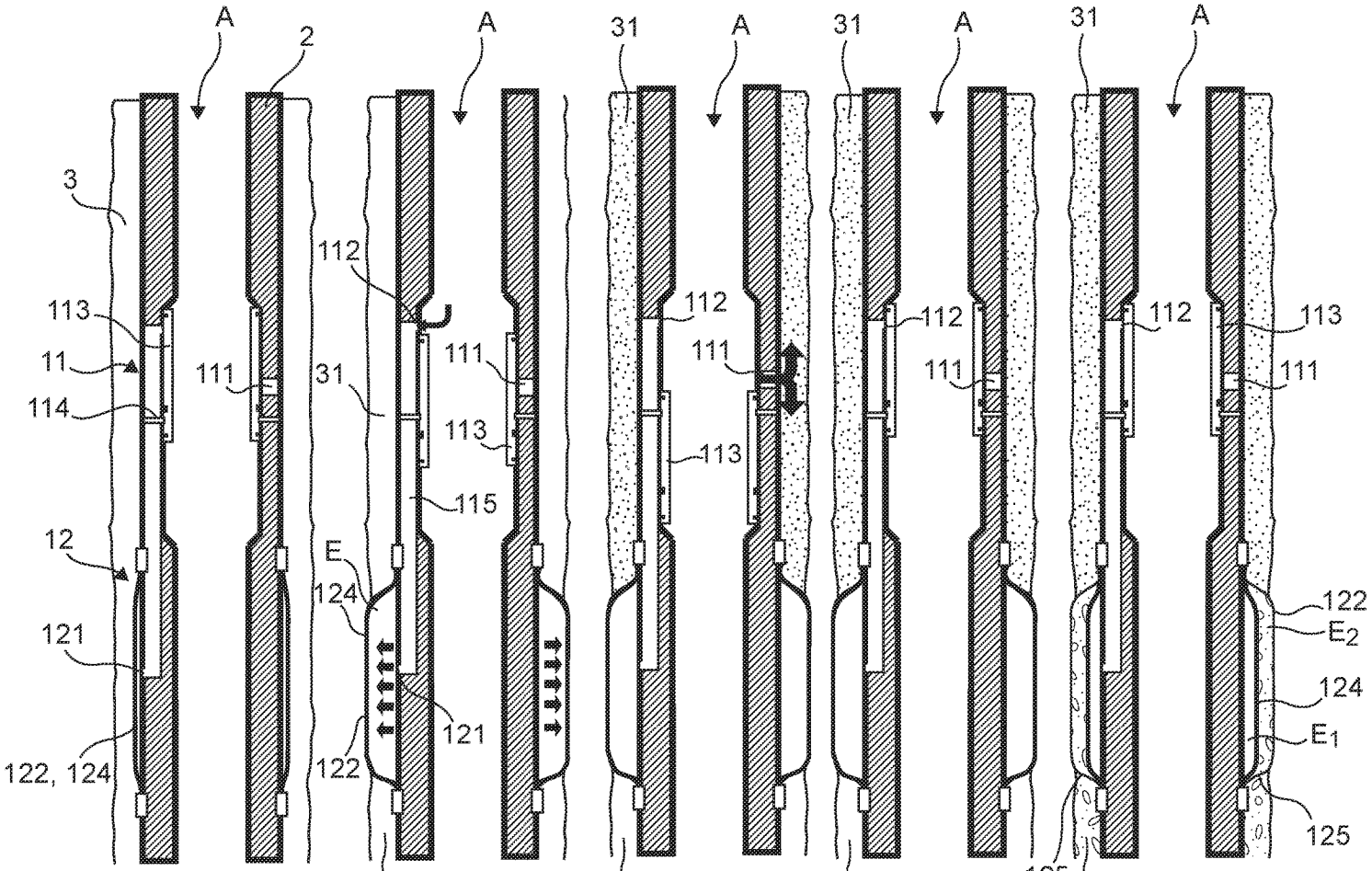
FIGS. 2A to 2E illustrate a first embodiment of the cementing device of the invention and show the successive steps for implementing the cementing method according to the invention.

In a first position illustrated in FIGS. 1 and 2A, the shutter sleeve 113 covers the cementing aperture 111 which extends through the wall of the casing 2. In this position, the aperture 111 is closed hermetically preventing any flow of fluid from the interior of the casing 2 towards the annular space 3 and vice versa.

In this first position, the shutter sleeve 113 furthermore covers the expansion (or swelling) aperture 112 for the liners 122, 124 of the packer 12.

More specifically, the shutter sleeve 113 is fixed temporarily to internal wall of the casing 2 in the first position by at least one breakable retaining element, taking the form of a shear pin/slug 114 designed in such a way that a predetermined force is needed to exceed the shear resistance of the shear pin/slug 114.

The shutter sleeve 113 thus needs a pre-determined force to be actuated so as to pass from the first position to the second position, then to the third position, described in detail here below (as emphasized here above, a tool is used to mechanically shift the shutter sleeve 113).

In a second position illustrated in FIG. 2B, the shear pin/slug 114 has broken and the shutter sleeve 113 slides downwards in the well A. The shutter sleeve 113 is in a second position in which it uncovers the expansion aperture 112 (step S2).

With the expansion aperture 112 being open, an expansion fluid for the liners 122, 124 is sent inside the casing 2 and is introduced by the expansion aperture 112 (step S3). The liners 122 and 124 get radially deformed simultaneously towards the exterior and the first external liner 122 gets applied against the wall of the well A. The packer 12, in a tightly sealed manner, isolates an annular part 32 of the well, situated beneath the packer 12, from another annular part 31, situated above the packer 12 and intended to be cemented.

In the third position illustrated in FIG. 2C, the shutter sleeve 113 has again slid downwards in the well A and uncovers the cementing aperture 111 (step S4). The injection of fluid in the casing 2 is then interrupted.

Cement is then injected into the casing 2 (step S5) and is directed by means of the cementing aperture 111 in the annular space 31 situated above the expanded liners.

After sufficient introduction of cement into the annular space 31, the cementing port 111 is closed to hold back the cement in the annular space 31 and enable it to harden.

In FIGS. 2D and 2E, the shutter sleeve 113 has shifted towards the top of the well A and is again in its first position (step S6).

As illustrated in FIG. 2D, the packer 12 thus serves as a base/support for the cement that has been cast into the annular space 31 around the casing 2. It protects the cement situated in the annular space during the solidification phase but also in the long term, under harsh conditions.

As shown in FIG. 2D, the packer 12 also prevents fluids/gas from rising towards the well head.

As shown in FIG. 2E, should a fluid communication arise between the space E1 and the annular space 31 situated above the packer 12, the two-liner structure of the packer 12 prevents fluids/gas from rising towards the well head. This figure shows the fluids/gas that has entered the interior of the volume E through the holes 125 of the first external liner 122 of the packer 12. In doing so, the fluids/gas fills the volume E2 and places the first external liner 122 flat against the wall of the well A. Under these conditions, the tight sealing is preserved and the risk of collapse of the first external liner 122 is eliminated. The packer 12 prevents fluids/gas from rising towards the well head and this provides for long-term tight sealing in the event of defects (cracks, formation of micro-annulus, etc) of the hardened cement situated in the annular space 31.

Figures 5A, 5B, 6:
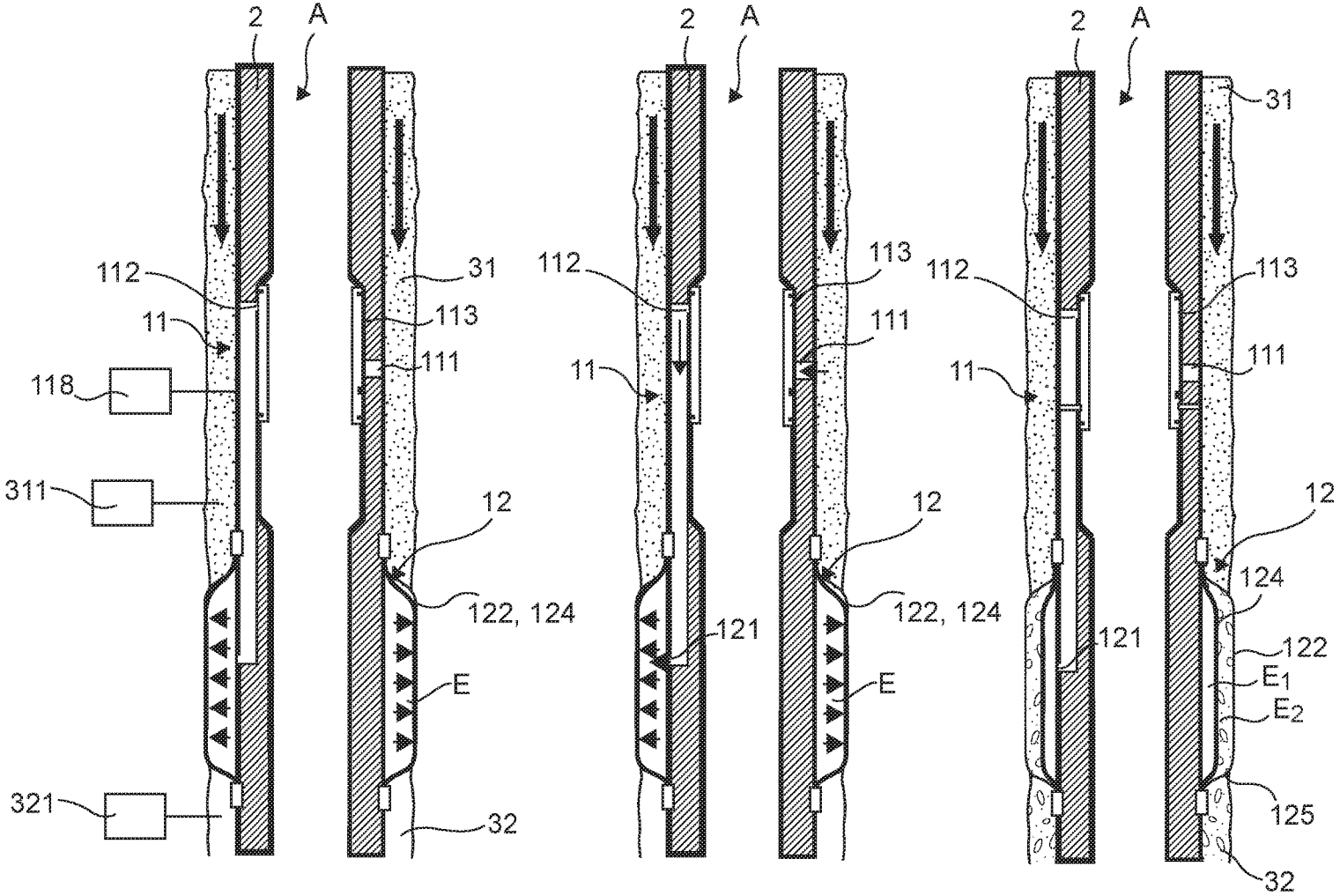
FIGS. 5A, 5B and 6 show the cementing device of the invention once the cementing has been done.

FIGS. 5A and 6 show the cementing device 1 as described here above, once the cementing of the annular space 31 has been done. The cementing aperture 111 and the expansion aperture 112 are herein closed in a tightly sealed manner by the shutter sleeve 113, the liners 122, 124 being expanded and applied in a tightly sealed manner against the wall of the well. The cement situated in the annular space 31 rests on the packer 12.

Even if, as illustrated in FIG. 1A, the weight of the cement situated above the liners 122, 124 exerts a downward pressure on these liners, the liners 122, 124 do not collapse because the expansion fluid is trapped in the volume E and remains applied in a tightly sealed manner against the wall of the well A.

In the event of gas rising from the bottom of the well towards the liners 122, 124, the pressure rushes into the space between the two liners 122, 124 through the holes 200 of the first external liner 122, the first external liner 122 remaining applied in a tightly sealed manner against the wall of the well A.

In the case illustrated in FIG. 5B, the shutter sleeve 113 covers both the cementing aperture 111 and the expansion aperture 112. It is in the first position. Since the cementing port 111 and the expansion port 112 are in fluid communication, there is a communication of fluid between the annular space 31 and the internal volume E of the liners 122, 124 which remain applied in a tightly sealed manner against the well of the of the well A.

The solution of the invention is therefore efficient and robust. It ensures the perennial character of the isolation between the part of the well situated downstream from the packer and the upstream part which is cemented, and ensures that this cemented part is supported.

FIGS. 3A to 3E illustrate a second embodiment of the cementing device 1 of the invention.

Figures 3A, 3B, 3C, 3D, 3E:
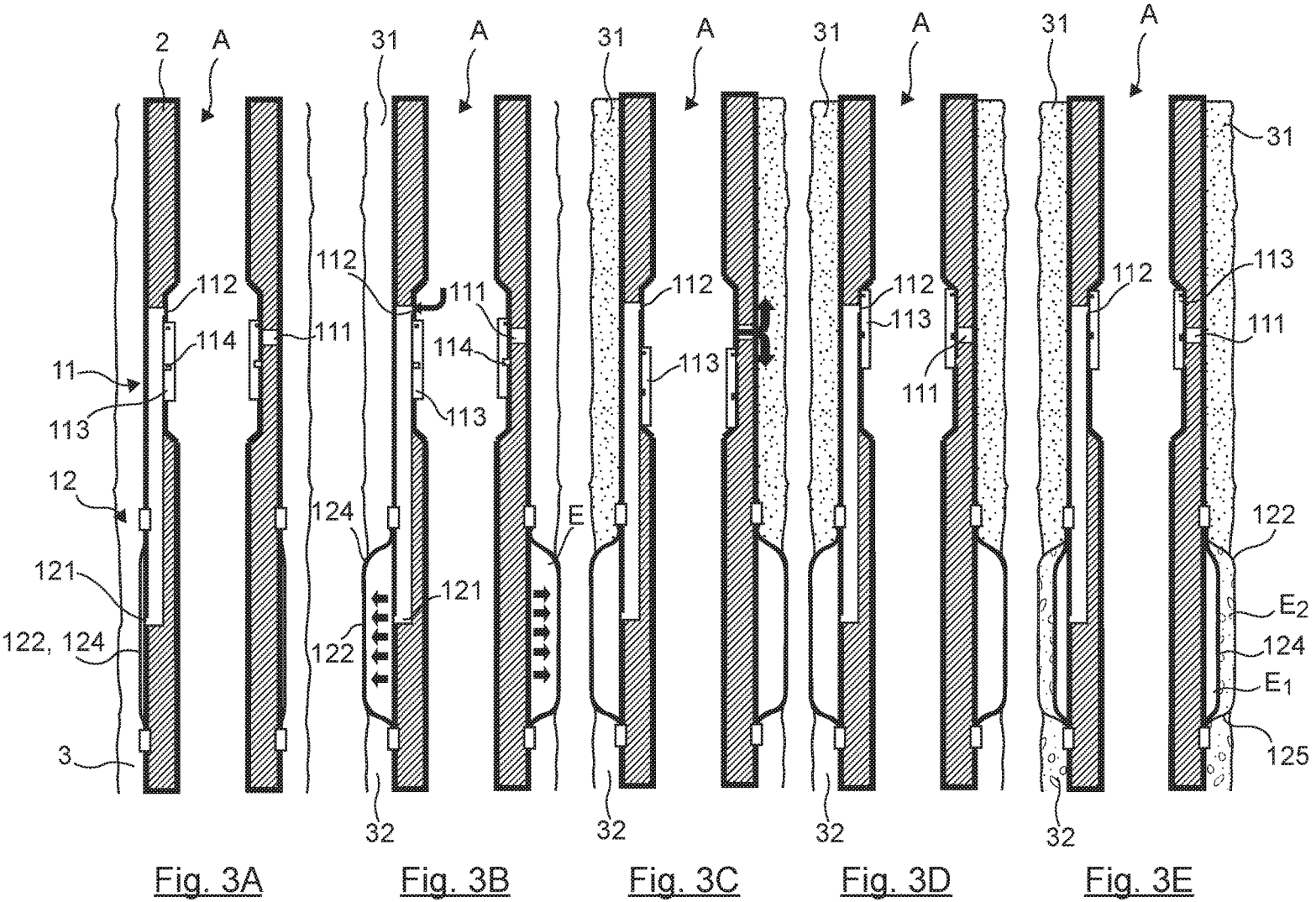
FIGS. 3A to 3E illustrate a second embodiment of the cementing device of the invention and show the successive steps for the implementing of the cementing method according to the invention.

Contrary to the above embodiment, when the casing 2 is placed in the well A, the shutter sleeve 113 does not cover the expansion aperture 112 but only the cementing aperture 111 (FIG. 3). The expansion aperture 112 can be protected by a system of rupture discs to prevent the migration of fluid into the insolation device 12. No shifting of the shutter sleeve 113 is therefore needed to initiate the expansion of the liners 122, 124 (FIG. 3B). Once the expansion is done, the shutter sleeve 113 is shifted towards the bottom of the well A (the shear pin/slug 114 is broken) so as to open also the cementing aperture 112. Once the cementing has been done (FIG. 3C), the shutter sleeve 113 is shifted towards the well head A so as to close the cementing aperture 112 and the expansion aperture 111 (FIGS. 3D and 3E).

Figures 4A, 4B, 4C, 4D, 4E:
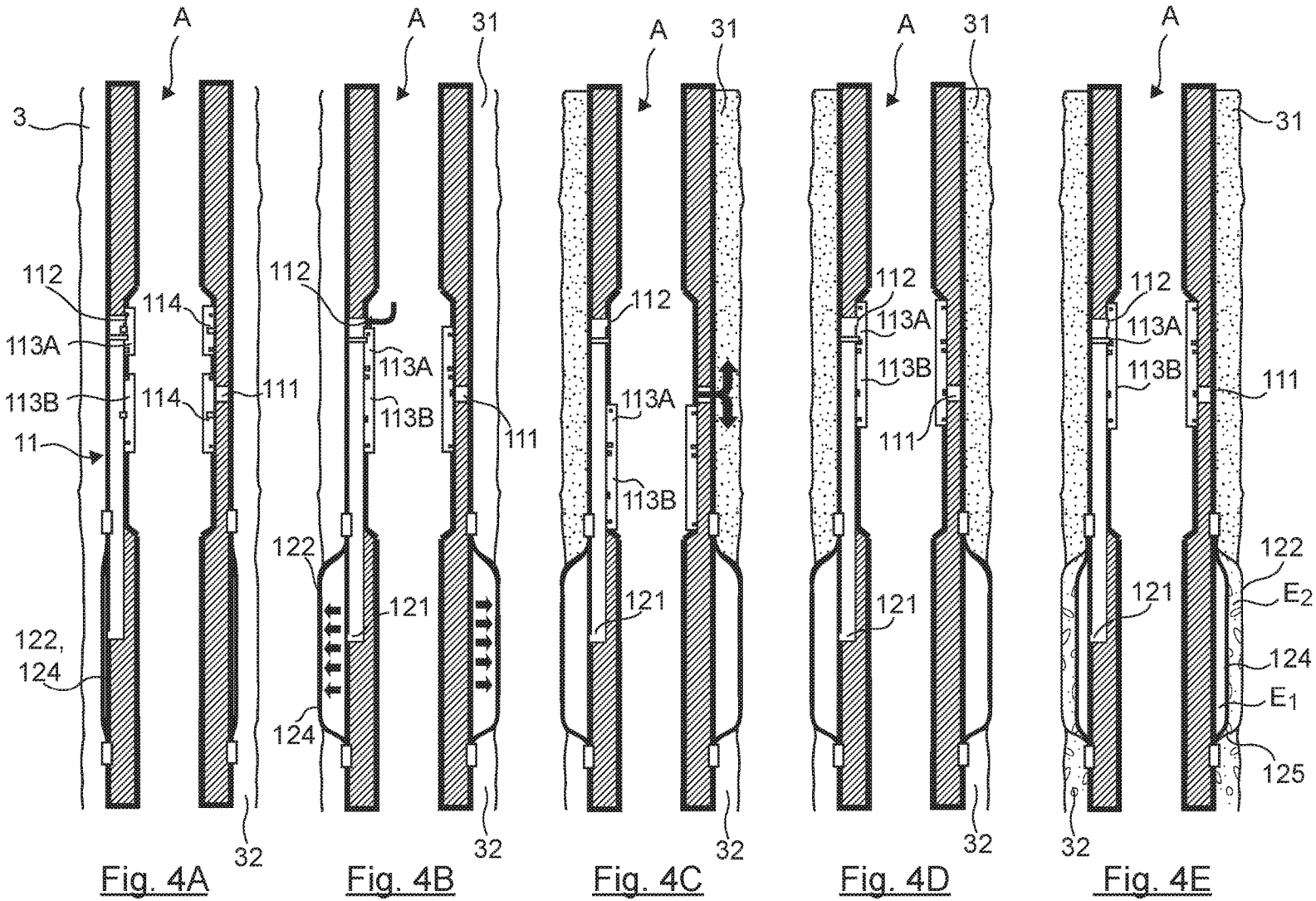
FIGS. 4A to 4E illustrate a third embodiment of the cementing device of the invention and show the successive steps for implementing the cementing method according to the invention.

FIGS. 4A to 4E illustrate a third embodiment of the cementing device of the invention. The shutter sleeve 113 is herein formed by two parts 113A, 113 which are axially mobile. When the casing 2 is placed in the well A (FIG. 4A), the upper shutter sleeve 113A covers the expansion aperture 112, the lower shutter sleeve 113B covers the cementing aperture 111. During this positioning operation, the two shutter sleeves 113A and 113B are distant from each other. The expansion fluid then moves the upper shutter sleeve 113A towards to the bottom of the well A (the shear pin/slug 114 is broken), the latter being placed flat against the shutter sleeve 113B so as to open the expansion aperture 112 (FIG. 4B), the lower shutter sleeve 113B still covering the cementing aperture 111. The two shutter sleeves 113A, 113B then move towards the bottom of the well A, remaining in contact (the shear pin/slug 114 of the lower shutter sleeve 113B is broken) in such a way that they uncover the cementing aperture 111. Once the cementing is done (FIG. 4C), the two shutter sleeves 113A, 113B move towards the well head A in such a way that they respectively cover and close the cement aperture 112 and the expansion aperture 111 (FIG. 4D and FIG. 4E).

In short, the expansion aperture 111 and cementing aperture 112 are open/closed according to the following sequence:

- during the descent of the casing 2 into the well A, the expansion aperture 111 is open or closed and the cementing aperture 112 is closed;
- during the expansion of the liners 112, 114 of the packer 12, the expansion aperture 111 is open and the cementing aperture 112 is closed;
- during cementing of the annulus 31, the cementing aperture 112 is open and the expansion aperture 111 is open or closed;
- once the cementing is done, the cementing aperture 112 and expansion aperture 111 are closed.

Other Aspects and Variants

In one variant, the wall of the first external liner 122 is devoid of holes 125.

By contrast, the hole (or the holes) 125 are situated between two of the extremities facing the liners 122, 124 and open into the part E2 of the space E between the two liners 122, 124.

The technique of the invention can be implemented in the horizontal part of well bore A.

The shutter sleeves 113 of the differential valve 11 can be moved:

- either hydraulically by injection of pressure into the casing;
- or by means of an actuating means known as a dart or plug that is conveyed by a flow of fluid into the casing;
- or by the descent of a tool provided with actuating means.

As illustrated, schematically in FIG. 5A, it can be planned to have measuring means (or sensors) of the position of the shutter sleeve or sleeves 113 of the differential valve 11.

Means are also provided to measure the pressure 311, 312 prevailing in the annular spaces 31 and 32 situated respectively upstream and downstream to the packer 12 so as to verify (and validate or not validate) the quality of the tightly sealed barrier formed by the expanded liners 122, 124.

These measuring means can communicate and especially transmit the measured data with a wireline type tool run down with a cable inside the casing 2.

Besides, the shutter sleeve or sleeves can take forms other than those illustrated in the embodiments described here above.

In one particular embodiment, the shutter means comprise:

- two shutter sleeves fixed temporarily to the internal wall of the casing by at least one breakable retaining element) the first of the two sleeves situated on the well bottom side shutter the cementing aperture, the second sleeve being situated on the well head side, and:
- a rupture disc shutting the expansion aperture so as to prevent the migration of fluid into the packer.

Sufficient pressure is injected into the casing to break the disc and release the expansion aperture, while the cementing aperture remains shuttered. Once this operation is done, the pressure is increased to expand the liners.

The cementing aperture is then opened by injection of pressure which shifts the first shutter sleeve towards the bottom of the well. Once the cementing is done, the casing is shuttered by a plug positioned upstream to the cementing device and taking support from the second shutter sleeve.

Sufficient pressure is injected into the casing to shift the second shutter sleeve, by means of the plug, towards the bottom of the well so that this well closes the expansion aperture and the cementing aperture.

The plug can then be pierced.

It must be noted that the device of the invention can be implemented to cement a casing within a well bore vessel.

The invention claimed is:

1. A device for cementing a casing in a well bore, wherein the device comprises:

on a head side of the well, a shutter, disposed within the casing, that controls opening and closing of at least one cementing aperture, said at least one cementing aperture making an interior of the casing communicate with an annular space situated between an external face of the casing and an internal wall of the well, on a bottom side of the well, a packer mounted along the external face of the casing, comprising:

an expandable liner, called a first external liner, the opposite extremities of which are fixedly attached to said external face of the casing, this casing, the first external liner and its extremities together demarcating an annular volume, the shutter furthermore commanding opening and closing of at least one expansion aperture, which makes the interior of the casing and said annular volume communicate, this first external liner being liable to expand and get applied, in a tightly sealed manner, on an intermediate part of its length, against the wall of the well, a second expandable liner, called a second internal liner, that extends between said casing and said first external liner, its extremities being also fixedly attached to the external face of said casing, at least one communication passage between an exterior of the first external liner and said annular volume, said at least one communication passage being situated on the packer side orientated towards the well bottom.

2. The device for cementing according to claim 1, wherein said at least one communication passage comprises a hole placed on the wall of said first external liner and leading into a part of said annular volume that extends between the two liners.

3. The device for cementing according to claim 1, wherein the shutter is axially mobile within the casing and can take a first position in which the shutter closes, at the same time, said at least one cementing aperture and said at least one expanding aperture, a second position in which the shutter closes said at least one cementing aperture and opens said at least one expanding aperture and a third position in which the shutter opens, at the same time, said at least one cementing aperture and said at least one expansion aperture.

4. The device for cementing according to claim 3, comprising a communication of fluid between a part of said annular volume that extends between the casing and the second internal liner and an annular space situated above the packer, between the external face of the casing and the internal wall of the well, when the mobile shutter is in said first position in which the shutter closes, at the same time, said at least one cementing aperture and said at least one expansion aperture.

5. The device for cementing according to claim 3, wherein the shutter is affixed temporarily on the internal wall of the casing in the first position by at least one breakable retaining element.

6. The device for cementing according to claim 1, wherein the shutter comprises at least one rupture disc closing at least one expansion aperture.

7. The device for cementing according to claim 1, wherein the shutter comprises two shutter sleeves that are axially mobile within the casing.

8. The device for cementing according to claim 7, wherein:

the shutter is axially mobile within the casing and can take a first position in which the shutter closes, at the same time, said at least one cementing aperture and said at least one expanding aperture, a second position in which the shutter closes said at least one cementing aperture and opens said at least one expanding aperture and a third position in which the shutter opens, at the same time, said at least one cementing aperture and said at least one expansion aperture; and one of said two shutter sleeves is temporarily affixed to the internal wall of the casing in the second position by at least one breakable retaining element.

9. The device for cementing according to claim 1, wherein the shutter is shifted by at least one of the following:

injection of pressure into the casing;

an actuator that is conveyed by the flow of fluid in the casing;

descent into the casing of a control tool.

10. The device for cementing according to claim 1, further comprising first means for measuring a position of the shutter within the casing.

11. The device for cementing according to claim 10, wherein the first measuring means are configured so that they communicate with a measuring tool taken down with a cable inside the casing.

12. The device for cementing according to claim 1, further comprising second means for measuring the pressure prevailing in annular spaces situated respectively upstream and downstream to the packer.

13. The device for cementing according to claim 12, wherein the second measuring means are configured so that they communicate with a measuring tool taken down with a cable inside the casing.

14. A method for cementing a casing in a well bore, wherein the method comprises:

placing, in said well, a casing equipped with a device for cementing, wherein the device comprises:

on a head side of the well, a shutter, disposed within the casing, that controls opening and closing of at least one cementing aperture, said at least one cementing aperture making an interior of the casing communicate with an annular space situated between an external face of the casing and an internal wall of the well, on a bottom side of the well, a packer mounted along the external face of the casing, comprising:

an expandable liner, called a first external liner, the opposite extremities of which are fixedly attached to said external face of the casing, this casing, the first external liner and its extremities together demarcating an annular volume, the shutter furthermore commanding opening and closing of at least one expansion aperture, which makes the interior of the casing and said annular volume communicate, this first external liner being liable to expand and get applied, in a tightly sealed manner, on an intermediate part of its length, against the wall of the well, a second expandable liner, called a second internal liner, that extends between said casing and said first external liner, its extremities being also fixedly attached to the external face of said casing, at least one communication passage between an exterior of the first external liner and said annular volume, said at least one communication passage being situated on the packer side orientated towards the well bottom, opening said at least one expansion aperture, said at least one cementing aperture being closed, injecting a fluid into the casing towards said at least one expansion aperture so as to enable the expansion of the first and second liners of the packer and, in a tightly sealed manner, apply the first external liner against the wall of the well, following the injecting, opening said at least one cementing aperture, injecting cement into the casing towards the annular space via said at least one cementing aperture, closing said at least one cementing aperture and said at least one expanding aperture.

* * * * *